US007171817B2

(12) United States Patent
Birgen

(10) Patent No.: US 7,171,817 B2
(45) Date of Patent: Feb. 6, 2007

(54) HEAT EXCHANGER LIQUID REFRIGERANT DEFROST SYSTEM

(76) Inventor: Daniel J. Birgen, 13209 - 278TH St. East, Graham, WA (US) 98338

( * ) Notice: Subject to any disclaimer, the term of this patent is extended or adjusted under 35 U.S.C. 154(b) by 24 days.

(21) Appl. No.: 11/027,394

(22) Filed: Dec. 30, 2004

(65) Prior Publication Data

US 2006/0144060 A1 Jul. 6, 2006

(51) Int. Cl.
*F25B 41/00* (2006.01)
*F25B 13/00* (2006.01)
*F25D 21/06* (2006.01)

(52) U.S. Cl. ..... 62/81; 62/151; 62/152; 62/156; 62/140; 62/196.4; 62/324.5

(58) Field of Classification Search ..... 62/81, 62/151, 155, 156, 140, 152, 196.4, 324.5, 62/277, 278
See application file for complete search history.

(56) References Cited

U.S. PATENT DOCUMENTS

| | | | | |
|---|---|---|---|---|
| 2,961,848 | A | 11/1960 | Nonomaque | 62/278 |
| 3,006,613 | A | 10/1961 | Coyne | 257/290 |
| 3,132,490 | A | 5/1964 | Schmidt | 62/81 |
| 3,138,007 | A | 6/1964 | Friedman et al. | 62/278 |
| 3,150,498 | A | 9/1964 | Blake | 62/81 |
| 3,283,809 | A | 11/1966 | Eberhart | 165/29 |
| 3,572,052 | A | 3/1971 | Toth | 62/278 |
| 3,633,378 | A | 1/1972 | Toth | 62/196 |
| 3,638,444 | A | 2/1972 | Lindahl | 62/81 |
| 4,024,722 | A | 5/1977 | McCarty | 62/81 |
| 4,083,195 | A | 4/1978 | Kramer et al. | 62/196 B |
| 4,122,688 | A | 10/1978 | Mochizuki et al. | 62/196 R |
| 4,279,129 | A | 7/1981 | Cann et al. | 62/278 |
| 4,437,317 | A | 3/1984 | Ibrahim | 62/81 |
| 4,625,524 | A | 12/1986 | Kimura et al. | 62/278 |
| 5,095,711 | A | 3/1992 | Marris et al. | 62/81 |
| 5,156,010 | A | 10/1992 | Inoue et al. | 62/81 |
| 5,332,028 | A | 7/1994 | Marris | 165/1 |
| 5,694,782 | A | 12/1997 | Alsenz | 62/156 |
| 5,758,507 | A | 6/1998 | Schuster et al. | 62/81 |
| 5,839,292 | A | 11/1998 | Hwang | 62/152 |
| 6,000,231 | A | 12/1999 | Alsenz | 62/81 |
| 6,418,737 | B1 | 7/2002 | Kuroki et al. | 62/156 |

*Primary Examiner*—Marc Norman
(74) *Attorney, Agent, or Firm*—Dean A. Craine

(57) ABSTRACT

A heat exchanger liquid refrigerant defrost system disclosed herein specifically designed to defrost the coil subsystems used on an outdoor heat exchanger used on a building heat pump unit or combination heat pump/air condition unit. The outdoor heat exchanger contains at least two coil subsystems each including having a first secondary bypass check valve, a secondary liquid line, a bypass solenoid, a suction solenoid, and a metering device. During use, the flow of warm liquid refrigerant through the coil subsystems is selectively controlled to defrost the coil subsystem one chamber at a time. The other coil subsystems continue to exchange heat and warm the building. When all of the coils systems are sequentially defrosted, all of the coil subsystems may operate in a heating mode or begin the defrost cycle again. Two important benefits of the system over a conventional heat exchanger are the amount of energy required to defrost the coil subsystem is reduced and a supplemental heat source is not needed.

10 Claims, 15 Drawing Sheets

COMBINATION HEATING AND COOLING

HEAT EXCHANGER LIQUID REFRIGERANT DEFROST SYSTEM

BACKGROUND OF THE INVENTION

1. Field of the Invention

This invention relates to refrigeration systems, and more particularly to heat pump and air conditioning units that include an automatic defrost cycle.

2. Description of the Related Art

In FIG. 1 is an illustration depicting the operation of a heat pump unit operating in heating mode. Refrigerant cool vapor is transmitted through outdoor coils, also called an evaporator, and delivered to a reversing valve. The reversing valve is switched to the heating mode position so that the cool vapor is delivered to a compressor, which pressurizes the refrigerant and converts it into a hot vapor. The hot vapor refrigerant is then delivered to a set of indoor coils, also called a condenser, where it releases its latent heat to the room.

The warm liquid refrigerant leaves the condenser and then flows through a bypass valve and into a main liquid line. The main liquid line delivers the warm liquid refrigerant through a second expansion valve, where it expands and vaporizes and gains latent heat from the outside air. The cool refrigerant vapor from the outdoor coils then travels through the reversing valve and returns to the compressor where the cycle begins again.

It is well known that heat pumps can operate in both a cooling mode and a heating mode. For example, FIG. 2 is an illustration of a heat pump operating in a cooling mode in which the hot vapor refrigerant exits the compressor at a temperature in the range of 120–140° F., and is transferred to the outdoor coils, called a condenser. When operating in a cooling mode, the hot vapor refrigerant enters the condenser where it looses heat and condenses. The warm liquid refrigerant leaves the condenser, travels through a by-pass valve, and enters an expansion valve that regulates its flow so that it can be completely vaporized in the indoor coils, called an evaporator. The pressure drop through the second expansion valve vaporizes some of the warm liquid refrigerant and lowers its temperature to 40–50° F. As a result, it spontaneously gains more heat. The low-pressure refrigerant vapor leaves the evaporator, travels through a reversing valve, and returns to the compressor, where the cool vapor refrigerant in transformed into hot vapor refrigerant. The cycle then begins again. The rest of the continuous supply of warm liquid refrigerant is vaporized by picking up latent heat from the inside air as it passes through the evaporator's coils.

It is well known that during cold weather, ice and frost build up on the evaporator of a heat pump when operating in a heating mode. If the build up of ice and frost continues and is not removed from the evaporator, the efficiency of the heat pump is gradually reduced.

Heat pumps used in the prior art have a defrost cycle that removes ice and frost on the evaporator by reversing the direction of the hot vapor refrigerant through the coils similar to the flow of refrigerant shown in FIG. 2. These systems are known as 'hot gas defrost systems'.

One important drawback with 'hot gas defrost systems' is that the unit's primary heating cycle must be reversed during the defrost cycle. When this occurs, not only is heat no longer added to the building, but heat from the warm air located inside the building is transmitted outside the building. In order to overcome the loss of heat from the building during the defrost cycle some buildings have secondary heating units. Unfortunately, these secondary heating units add to the overall cost of the heating and cooling systems.

SUMMARY OF THE INVENTION

It is an object of the present invention to provide a heat exchange system for a heat pump or combination heat pump/air conditioning unit that automatically defrosts the systems' outdoor coils during use.

It is another object of the present invention to provide such a heat exchange system that continues to supply heat to the building as the outdoor coils are defrosted.

These and other objects of the invention are met by a heat exchanger liquid refrigerant defrost system disclosed herein specifically designed to defrost the coils used on an outdoor heat exchanger used on a building 'heat only' type heat pump unit (called a 'heat pump', herein after) or combination heat pump/air conditioning unit. The system is specifically designed to be used with most or all of the inside components commonly used on a standard heat pump or combination heat pump/air conditioning unit so that the system may be easily retrofitted on existing units or easily incorporated into new systems with a minimal number of new components.

The system includes an outdoor heat exchanger containing at least two coil subsystems. Each coil subsystem is connected to a main liquid line that connects to an indoor heat exchange coil system. Each coil subsystem includes an inlet tubing section that extends between the main liquid line to a t-joint connected to a first end tube section. Disposed on the inlet tubing section is a bypass solenoid. Disposed in the first end tube section is a suction line solenoid. The distal end of the first end tube section connects to an outdoor refrigerant transfer line which extends into the building and connects to a suction accumulator when used with a heat pump unit or connects to a reversing valve when used on a combination heat pump/air conditioning unit.

Each coil subsystem winds back and forth inside the outside heat exchanger's outer housing and terminates at a second end tube section. Disposed in the second end tube section is a metering device and bypass check valve. The distal end of the second end tube section connects to a secondary liquid line that extends between all of the coil subsystems located in the outer housing. The opposite end of the secondary liquid line connects to the indoor unit's liquid line. Located near the distal end of the secondary liquid line is a liquid restrictor valve.

When the system is used in a combination heat pump/air conditioning unit, a secondary conduit with a second bypass check valve disposed therein is placed between the distal end of the secondary liquid line and the main liquid line and parallel to the liquid restrictor valve.

During use, the bypass solenoid and the suction line solenoid, the metering device, the bypass check valve, the liquid restrictor valve, and the secondary check valve operate in a coordinated manner so that the flow of warm liquid refrigerant through the coil subsystems in the outdoor heat exchanger is optimized to exchange heat. In the preferred embodiment, the bypass solenoid and the suction line solenoid are electrical units controlled by a central control unit. The metering device, which is located side-by-side to the first bypass check valve in the secondary tube section, is used to change the state of the refrigerant from a warm liquid flowing through said second tube section to a vapor. When the coil subsystem operates in defrost mode, warm liquid refrigerant flows through the first bypass check valve and directly into the secondary tube section. During operation, the restrictor valve disposed in the secondary liquid line selectively opens or closes in a direction opposite to the bypass solenoid. The restrictor valve too may be an electrical valve and controlled by the central control unit. Alternatively, the restrictor valve may be a mechanical valve or a pneumatic valve.

When defrosting on one or more of the coil subsystems is necessary, the control unit selectively controls the operation of the bypass solenoid and the suction line solenoid so that the coil subsystems are individually and sequentially defrosted one or two at a time while the other coil subsystems continue to exchange heat. When all of the coils subsystems have been defrosted, all of the coil subsystems may resume normal operating mode and exchange heat or begin another defrost cycle again.

During the heat mode, warm liquid refrigerant is delivered to all of the coil subsystems in the outdoor heat exchanger. The warm liquid refrigerant travels through a metering device and evaporates inside the coil subsystems, thus gaining latent heat from the outside air.

When the unit is switched to defrost mode, the positions of the solenoids and valves are altered so that warm liquid refrigerant is only directly transmitted to the coil subsystem(s) to be defrosted. When the warm liquid refrigerant leaves the defrosted coil subsystem(s), it is delivered to the other coil subsystems where it evaporates and gains the latent heat from the outside air.

Because warm liquid refrigerant is first used to defrost a coil subsystem and then delivered to the remaining coil subsystems to undergo heat exchange, the amount of energy required to defrost the coil subsystems in the outside heat exchanger is lower than the amount of energy normally needed to defrost the single coil used in a standard outdoor unit. Also, because the other coil subsystems continue to exchange heat while one coil subsystem is defrosted, the heated air is continuously provided to the building thereby eliminating the need for a supplemental heat source.

DESCRIPTION OF THE PREFERRED EMBODIMENT(S)

Figure 1:
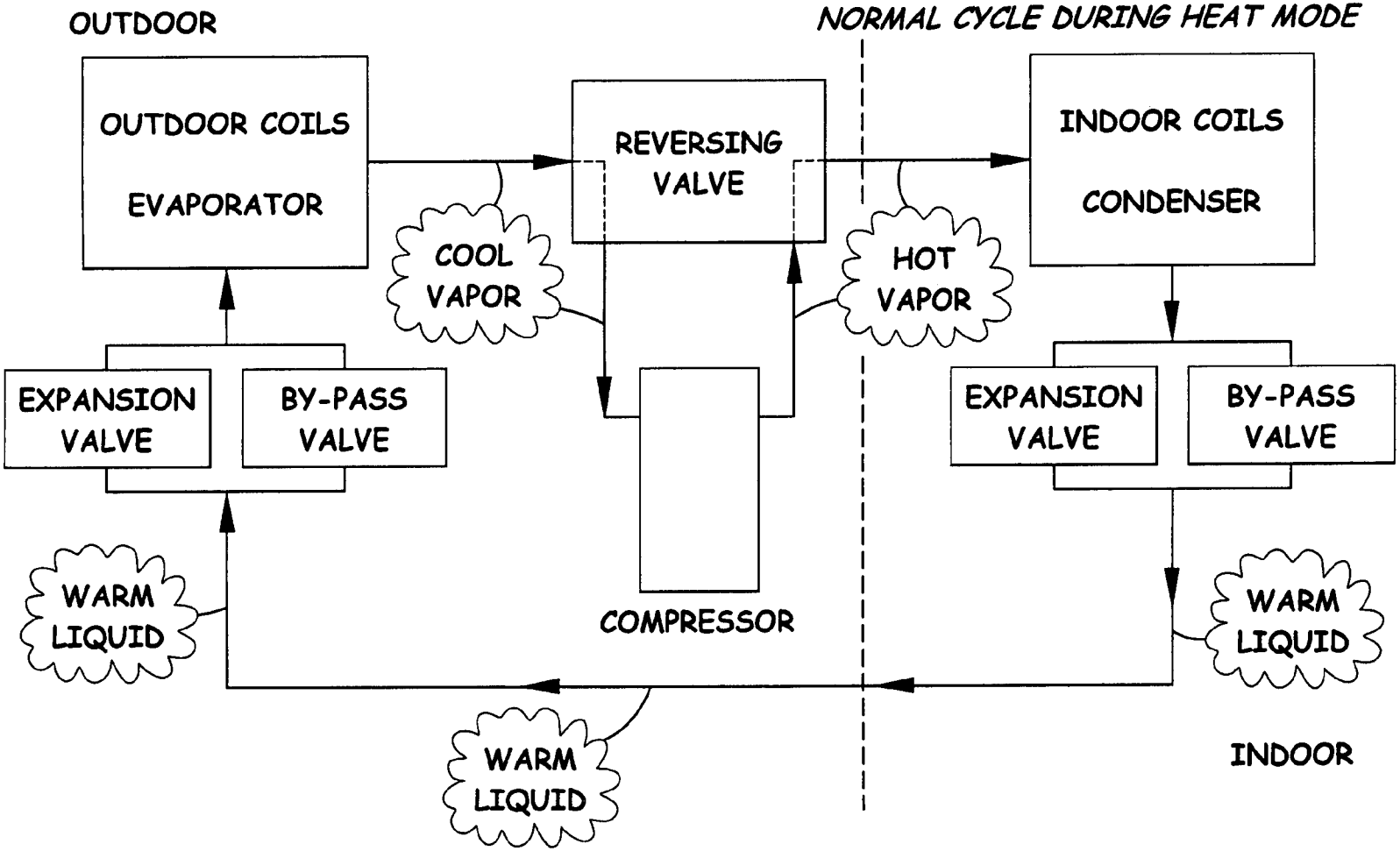
Fig. 1 (PRIOR ART)
FIG. 1 is a diagram of a heat pump in the prior art operating in a normal heating mode.
Figure 2:
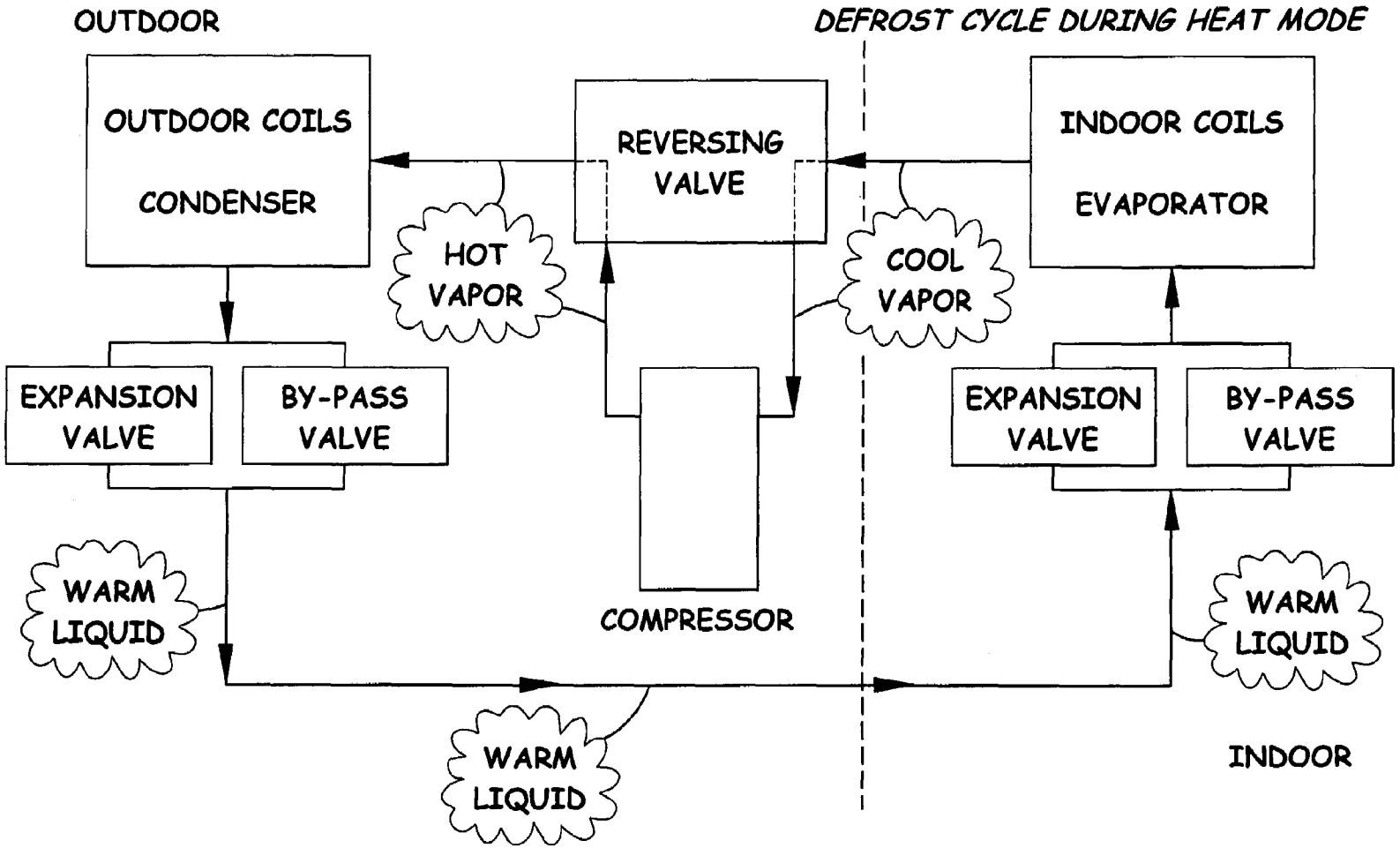
Fig. 2 (PRIOR ART)
FIG. 2 is a diagram of a heat pump depicted in FIG. 1 operating in a defrost mode.

Referring to the accompanying FIGS. 3A–E and FIGS. 4A–F, there is shown a heat exchanger liquid refrigerant defrost system 10 specifically designed to automatically defrost one or more coils systems on an outdoor heat exchanger used with a building's heat pump unit 1 or combination heat pump/air conditioning unit 2. While one coil subsystem 10 is defrosting, the other coils systems continue or operate normally and exchange heat for the building. The system 10 includes an outdoor heat exchanger 12 that replaces the outdoor heat exchanger commonly used with the standard heat pump unit or combination heat pump/air conditioning unit. The outdoor heat exchanger 12 is specifically designed to be used with existing indoor components (i.e. suction accumulator 76, compressor 80, reversing valve 90, indoor coil subsystem 85, second bypass check valve 87, etc, ) commonly used with the standard heat pump unit or combination heat pump/air conditioning unit, thereby allowing it to be used with new units or retrofitted with existing units.

The heat exchanger 12 includes an outer housing 14 containing at least two interconnected yet separate coil subsystems. In the embodiment shown in the Figures, the outer housing 14 is a rigid structure with four coil subsystems 16, 17, 18, and 19 located therein. Referring to FIG. 5 which shows a representative coil subsystem denoted 18 in greater detail, each coil subsystem 16, 17, 18, 19 includes an inlet tubing section 20 that extends between the main liquid line 65 to a t-joint 22 connected to a first end tube section 24. Disposed on the inlet tubing section 24 is a first bypass solenoid 40 and disposed in the first end tube section 24 is a suction line solenoid 45. The distal end of the first end tube section 24 connects to an outdoor refrigerant transfer line 55 which connects to all of the coil subsystems 16–19 and extends into the building and connects to a suction accumulator 76 when used with a heat pump unit 1 as shown in FIGS. 3A–E or connects to a reversing valve 90 when used on a combination heat pump/air conditioning unit 2 as shown in FIGS. 4A–F.

Each coil subsystem 16–19 includes a main body section 26 which winds back and forth inside the outer housing 14 and terminates at a second end tube section 28. Disposed in the second end tube section 28 is a metering device 30 and a first bypass check valve 50 aligned in a side-by-side manner. The distal end of the second end tube section 28 that extends beyond the metering device 30 and the first bypass check valve 50 connects to a secondary liquid line 35 that extends between all of the coil subsystems 16–19. The opposite end of the secondary liquid line 35 connects to the main liquid line 65 located below the last coil subsystem 19.

Located near the distal end of the secondary liquid line 35 is a liquid restrictor valve 60 which controls the flow of refrigerant there between. As shown in FIGS. 4A–F and FIGS. 7 and 8, when the system is used in a combination heat pump/air conditioning unit 2, a secondary conduit 62 is provided with a second bypass check valve 64 disposed therein. The secondary conduit 62 is placed between the distal end of the secondary liquid line 35 and the main liquid line 65 and parallel to the liquid restrictor valve 60.

Figure 3A:
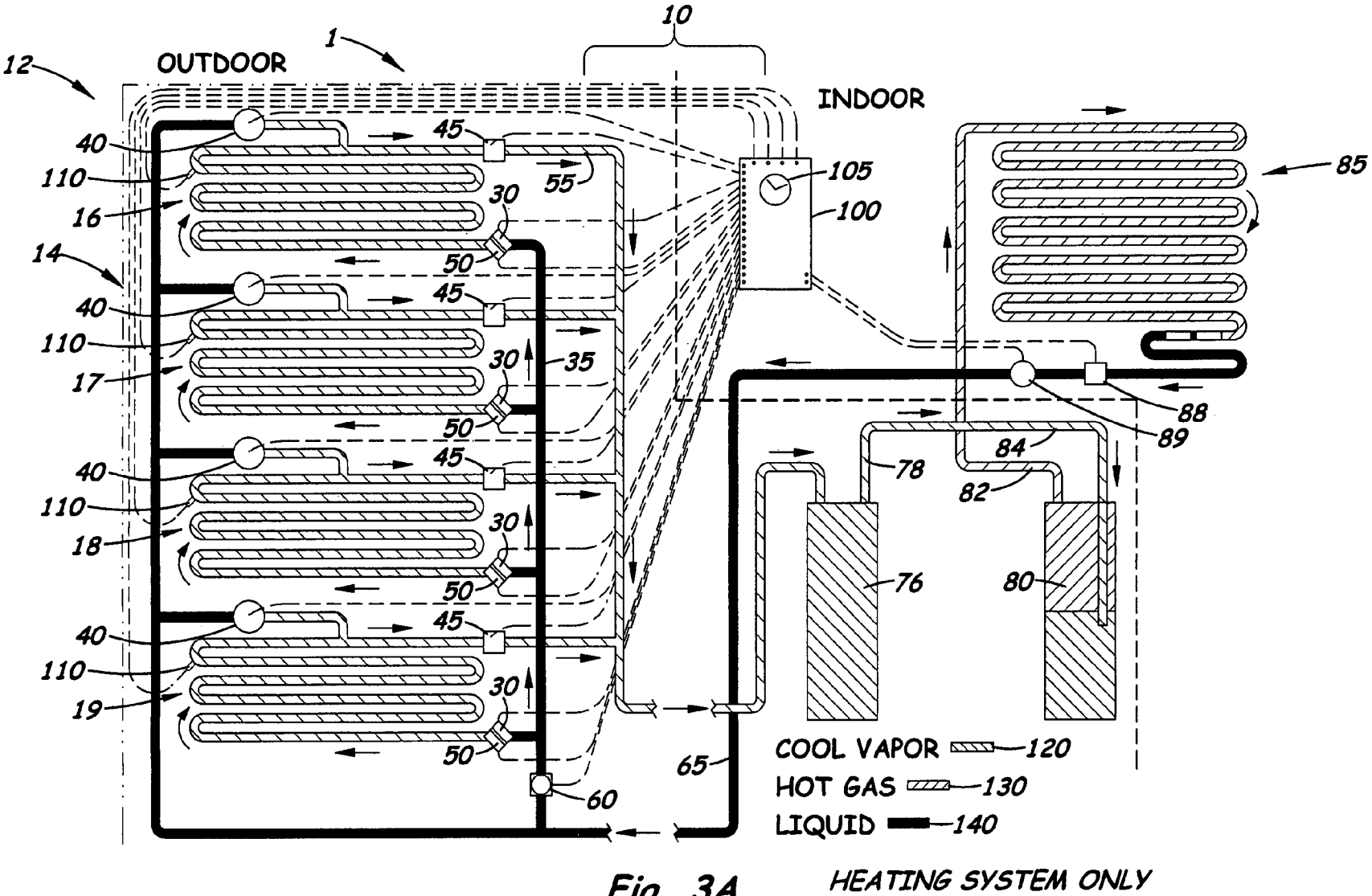
FIGS. 3A–3E are a series of diagrams of a heat pump only system that uses the liquid defrost system disclosed herein showing the initial operating condition of the outdoor heat exchanger with four coil subsystems being used to provide heat and then individually switched to a defrosted mode.
Figure 3B:
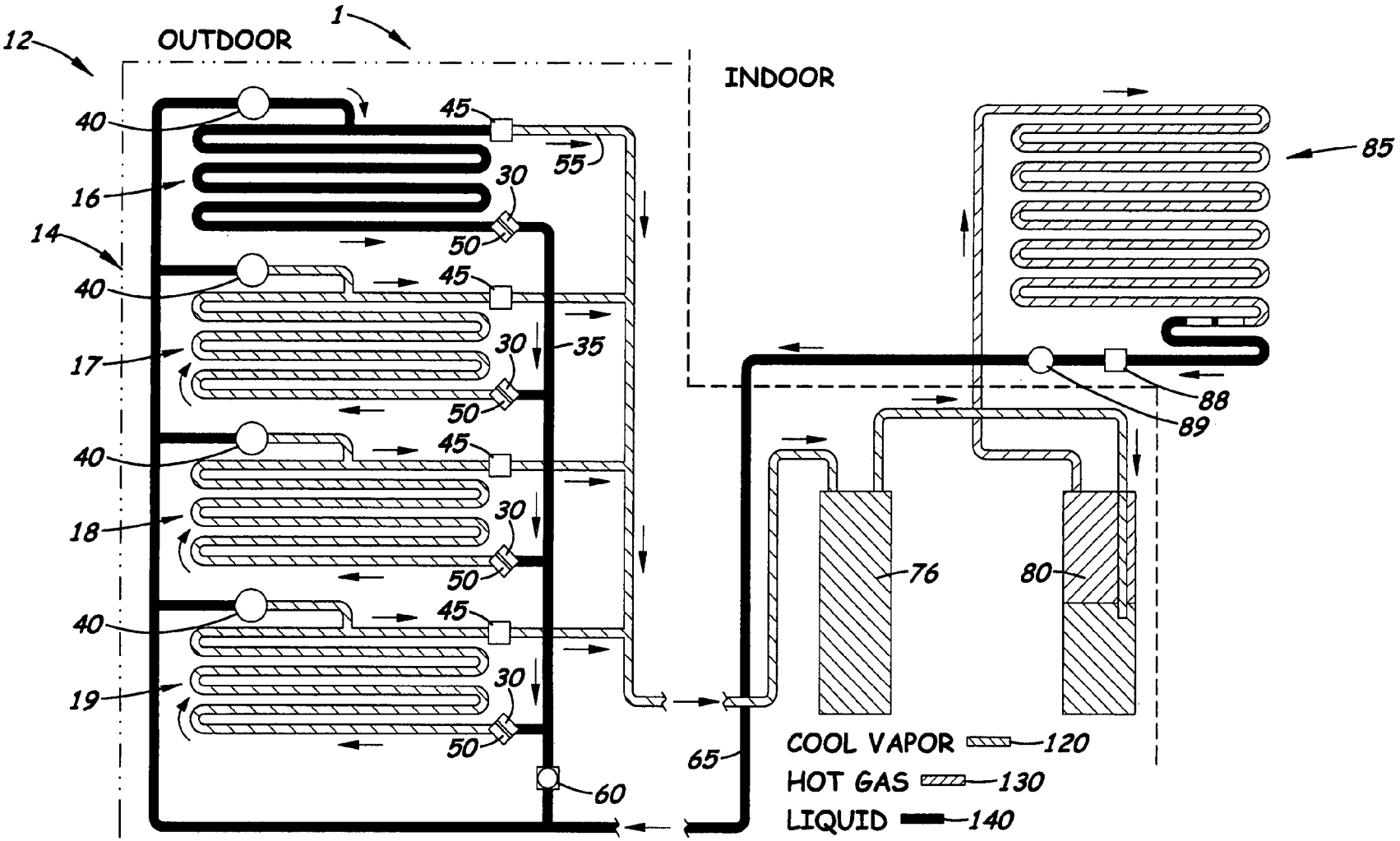
Figure 3C:
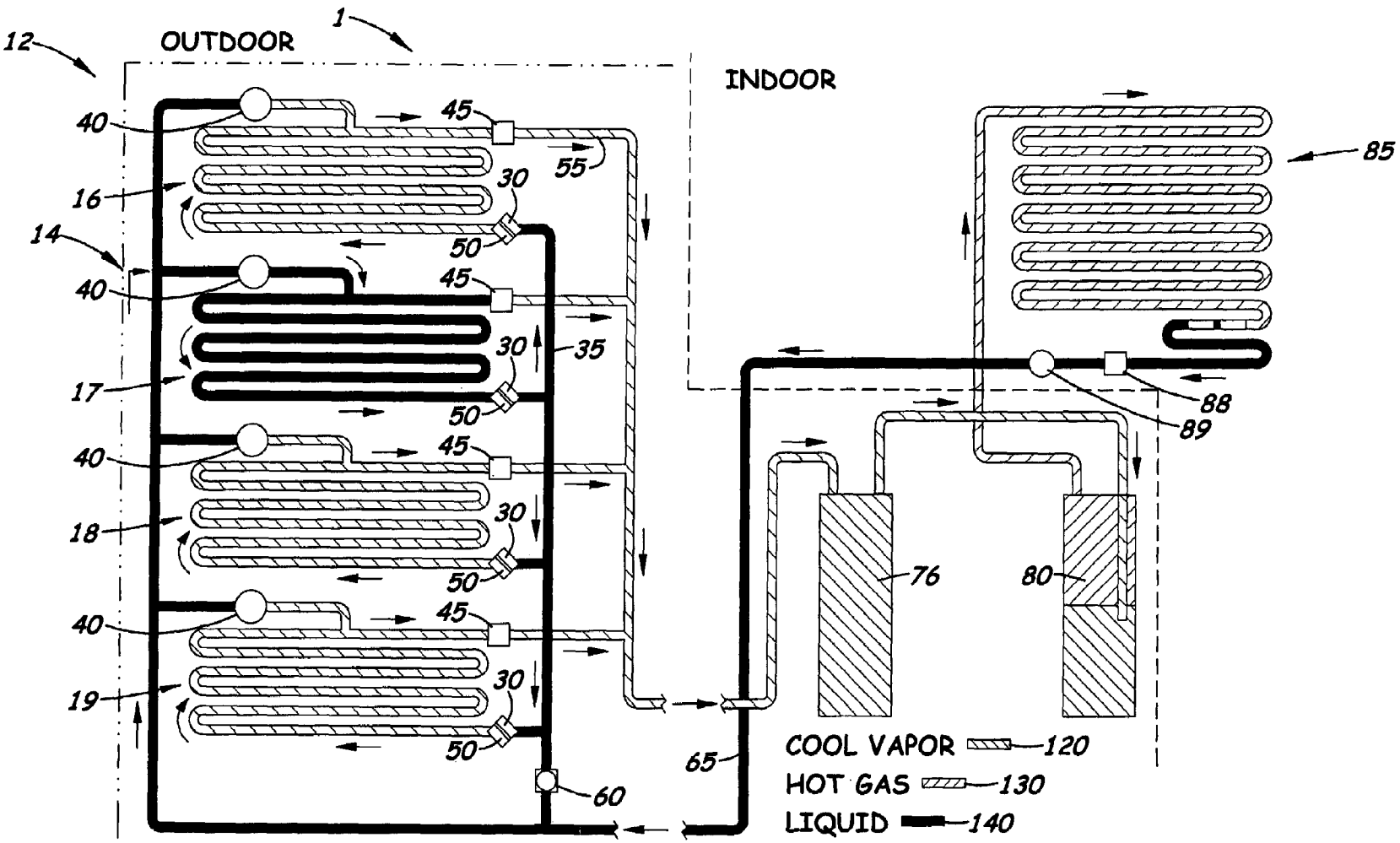
Figure 3D:
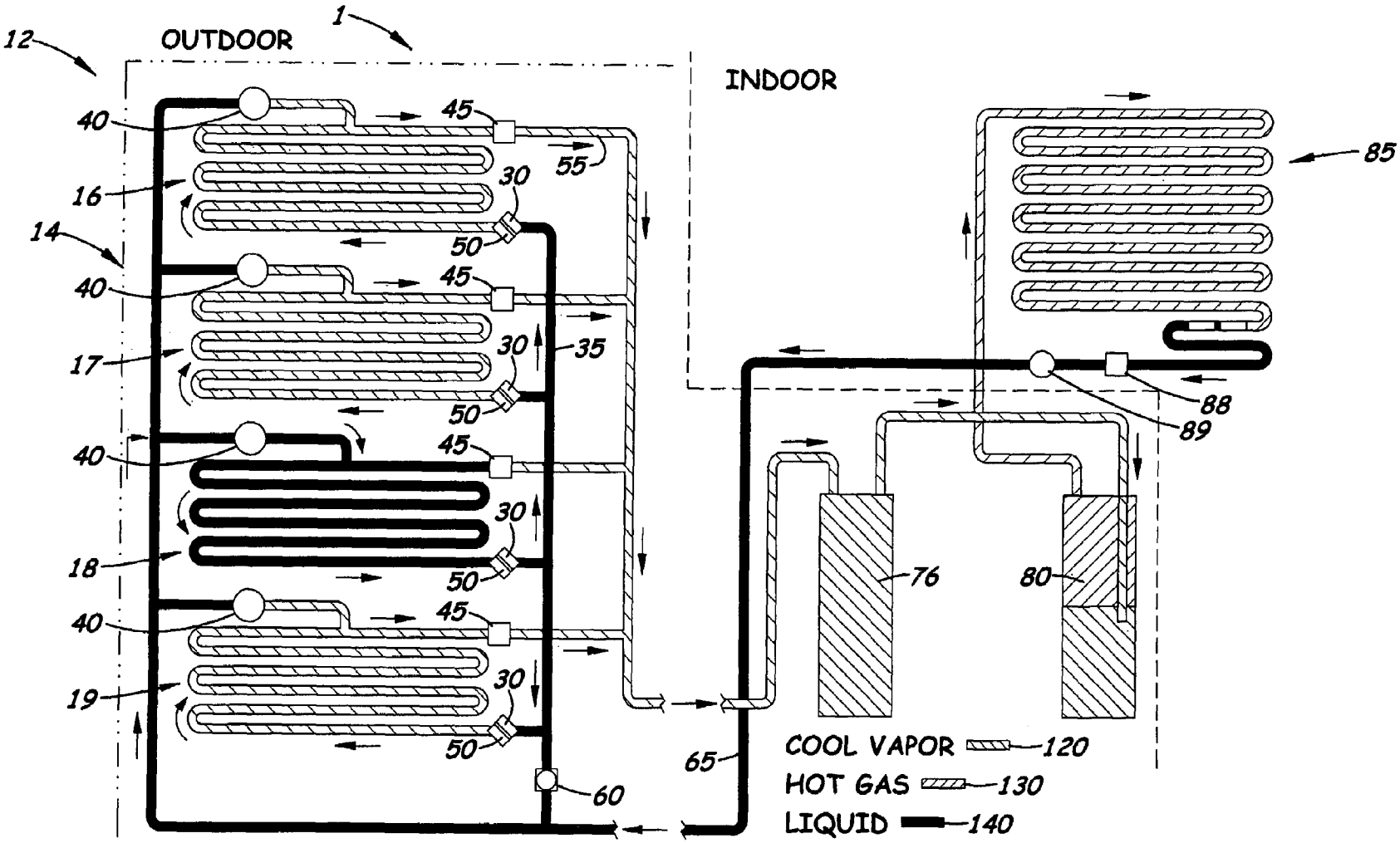
Figure 3E:
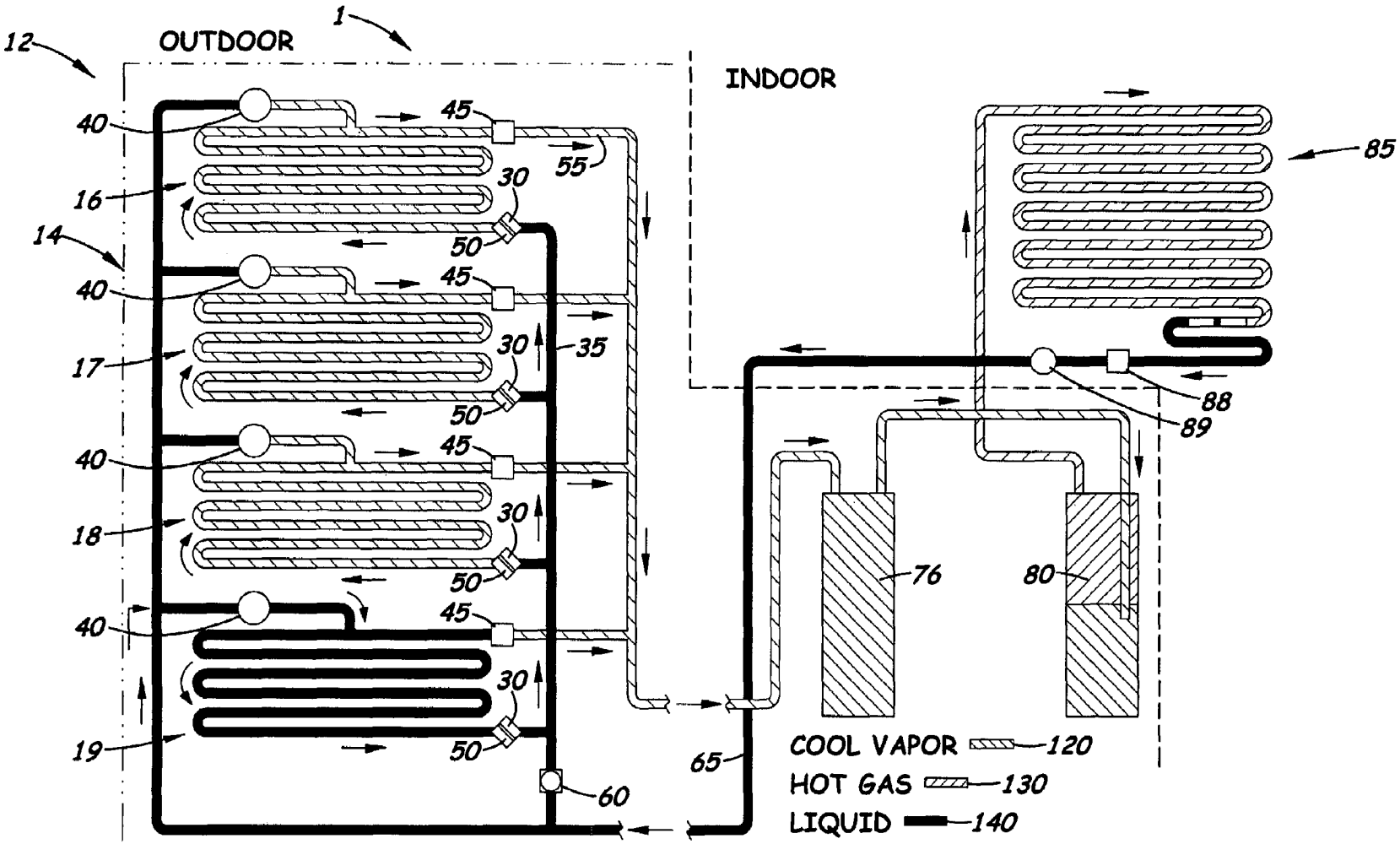

As shown in FIGS. 3A and 5, when the heat pump 1 is operating in a heating mode, the bypass solenoid 40 is closed and the restrictor valve 60 is opened so that warm liquid refrigerant 140 from the indoor coil subsystem 85 may flow through the metering device 30 and into the main body sections 28 of each coil subsystem 16–19. The warm liquid refrigerant 140 travels through the metering device 30 and evaporates and is converted into a cool vapor refrigerant 120. The suction line solenoid 45 on each coil subsystem 16–19 is opened so that the cool vapor refrigerant 120 may enter the outdoor refrigerant transit line 55 and return to the suction accumulator 76. The cool vapor refrigerant 120 then is delivered to a compressor 80, which causes it to condense into a hot gas refrigerant 130 that is transferred to the indoor coil subsystem 85.

Figure 4A:
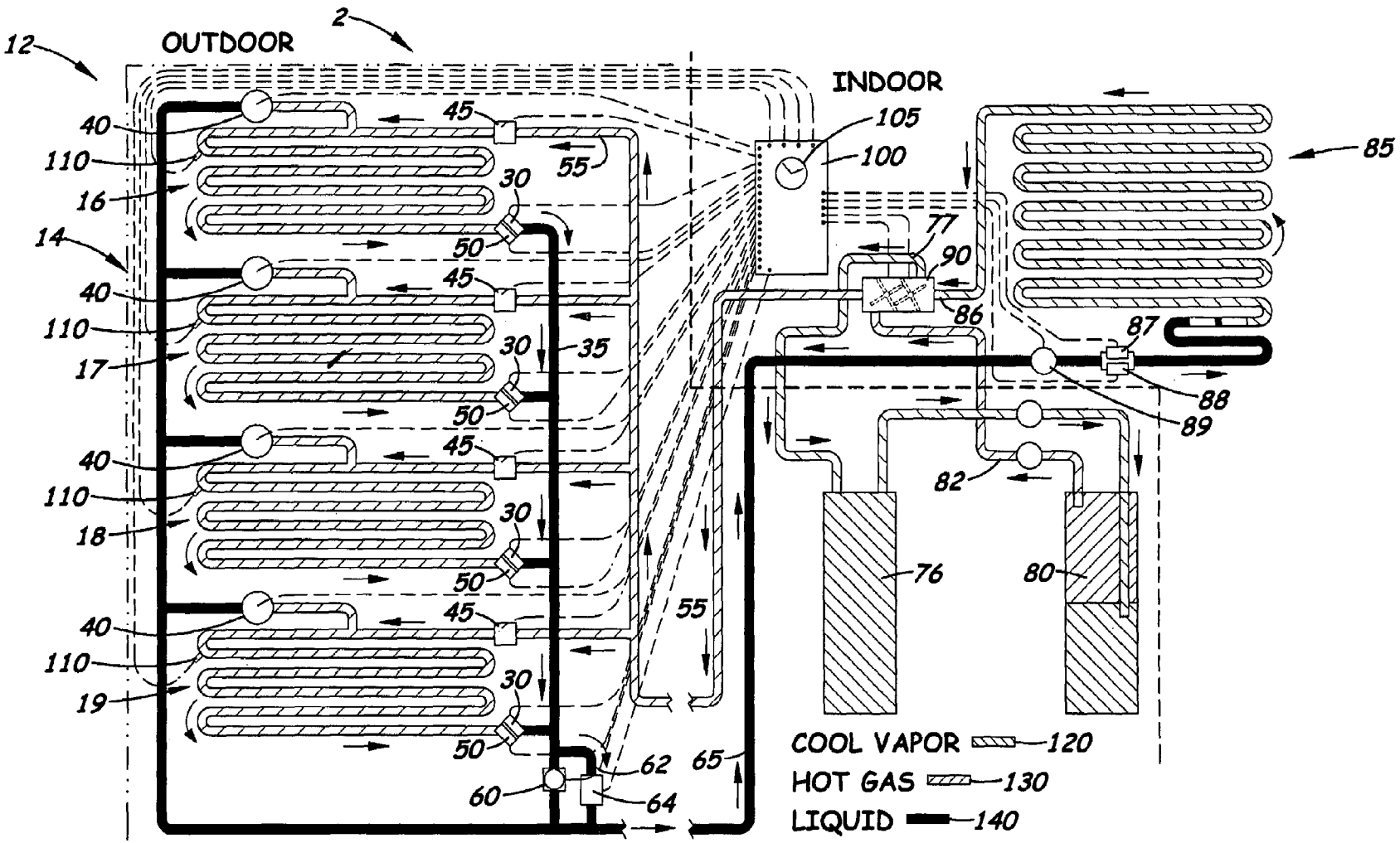
FIG. 4A is a diagram of a combination heat pump/air conditioning unit that uses the liquid defrost system disclosed herein showing the initial operating condition of the outdoor heat exchanger with four coil subsystems being used to provide cool air for air conditioning.
Figure 5:
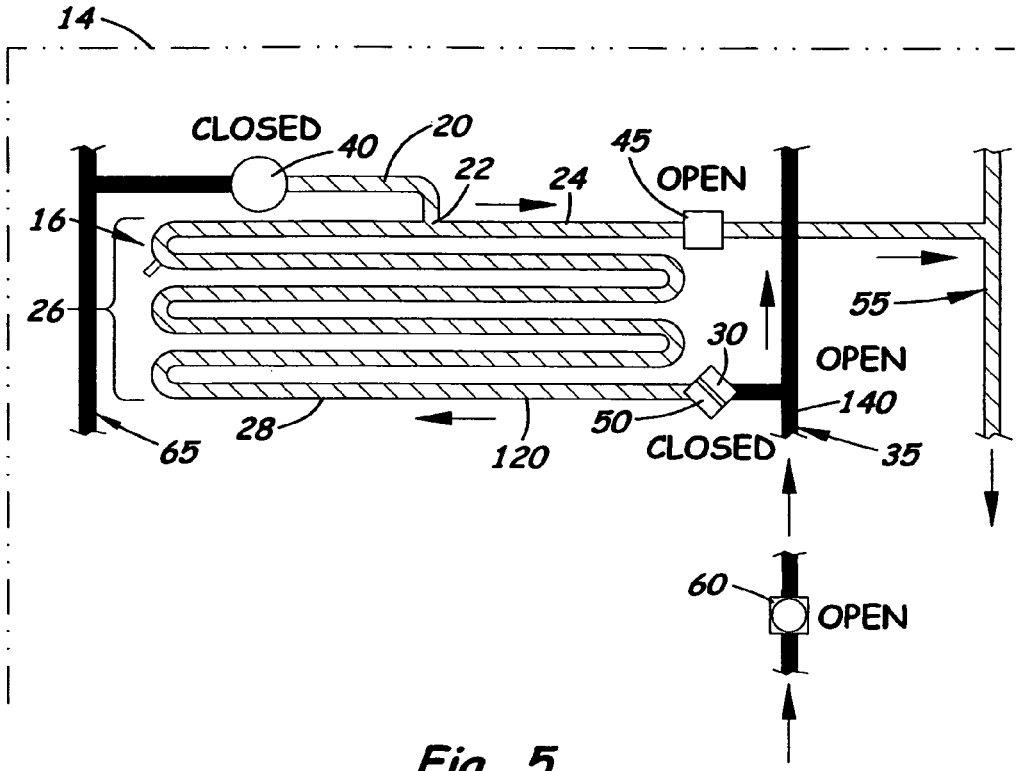
FIG. 5 is an illustration showing the flow of cool vapor refrigerant through one coil subsystem used to exchange heat.

FIG. 4A shows the operation of the combination heat pump/air conditioning unit 2 in a cooling mode. Hot gas refrigerant 130 from the compressor 80 is delivered via a short tubing 82 to the reversing valve 90. From the reversing valve 90, hot gas refrigerant 130 is then delivered to the outdoor refrigerant transfer line 55. Hot gas refrigerant 130 from outdoor refrigerant transfer line 55 passes into the coil subsystems 16, 17, 18, 19 via the four port suction line solenoids 45. The bypass solenoid 40 on each coil subsystem 16, 17, 18, 19 is closed thereby forcing the hot gas refrigerant 130 to travel through the main body portion 26 in each coil subsystem and then through the first bypass check valve 50. As the hot gas refrigerant 130 travels through the coil subsystems it releases its latent heat to the outside air. The hot gas refrigerant 130 condenses into a warm liquid refrigerant 140, which then flows through the secondary liquid line 35. The warm liquid refrigerant 140 from all of coil subsystems is then collected in the secondary liquid line 35 and transmitted through the second bypass check valve 64 and eventually to the main liquid line 65. The main liquid line 65 extends into the building and connects to the inside coil subsystem 85 after traveling through a moisture indicator 89, and a second metering device 88. The warm liquid refrigerant 140 then travels to the inside coil subsystem 85 where it evaporates and re-forms a cool vapor refrigerant 120. From the inside coil subsystem 85 the cool vapor refrigerant 120 travels via a return conduit 86 to the reversing valve 90.

Located inside the reversing valve 90 are two control gates 92, 94 that control the flow of cool vapor refrigerant 120 and hot gas refrigerant 130 there through. When cool vapor refrigerant 120 is delivered to the reversing valve 90 via the return conduit 86 the second control gate 94 is rotated so that the cool vapor refrigerant 120 is delivered to the suction accumulator 76. The first control gate 92 is also rotated so that hot gas refrigerant 130 delivered from the compressor 80 via line 82 is delivered to the outside refrigerant transit line 55. The outlet port on the suction accumulator 76 is connected to the inlet port on the compressor 80 to complete the circuit.

Figure 4B:
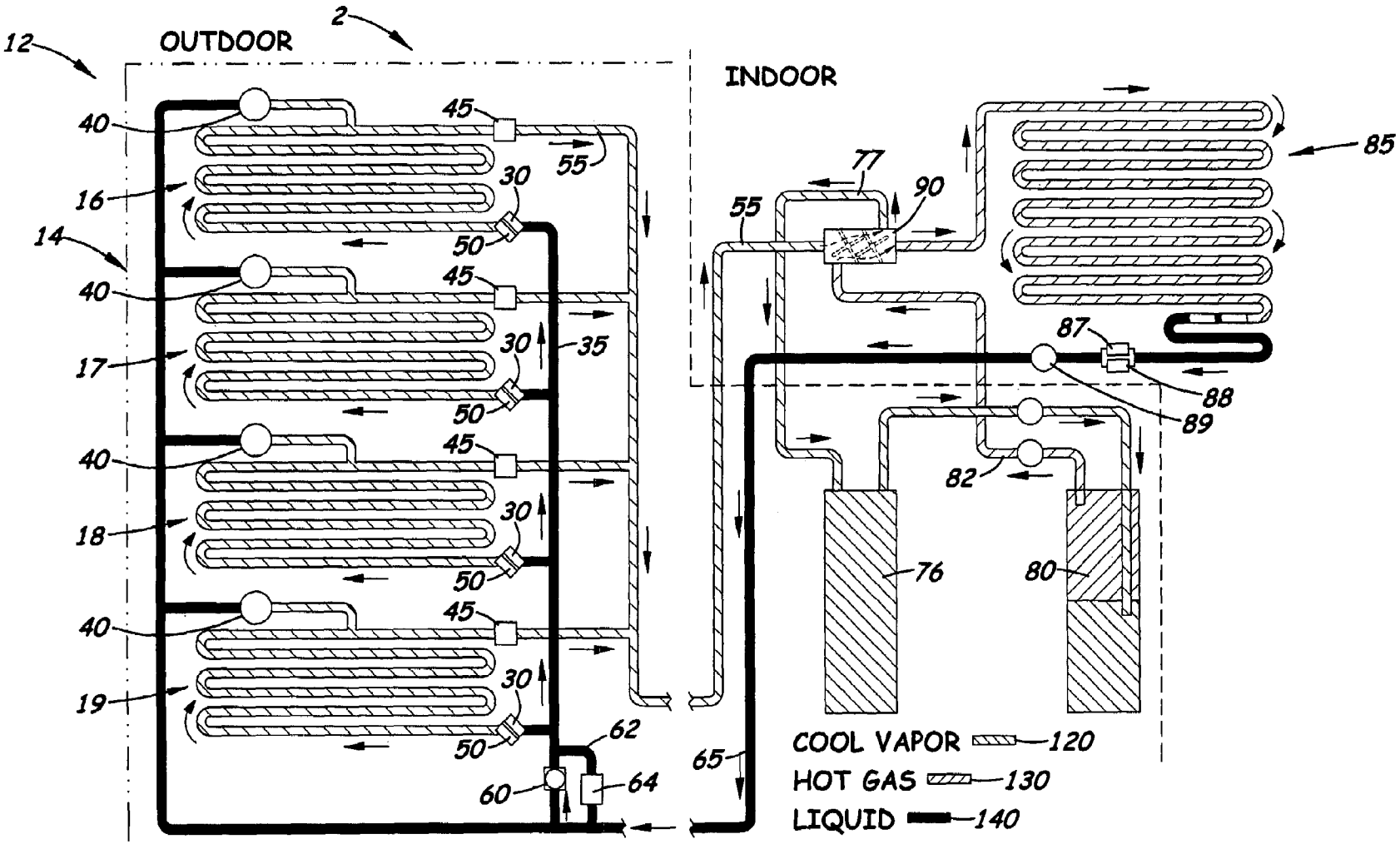
FIG. 4B is a diagram of the combination heat pump/air conditioner unit shown in FIG. 4A operating in a heating mode to provide indoor heat.
Figure 4C:
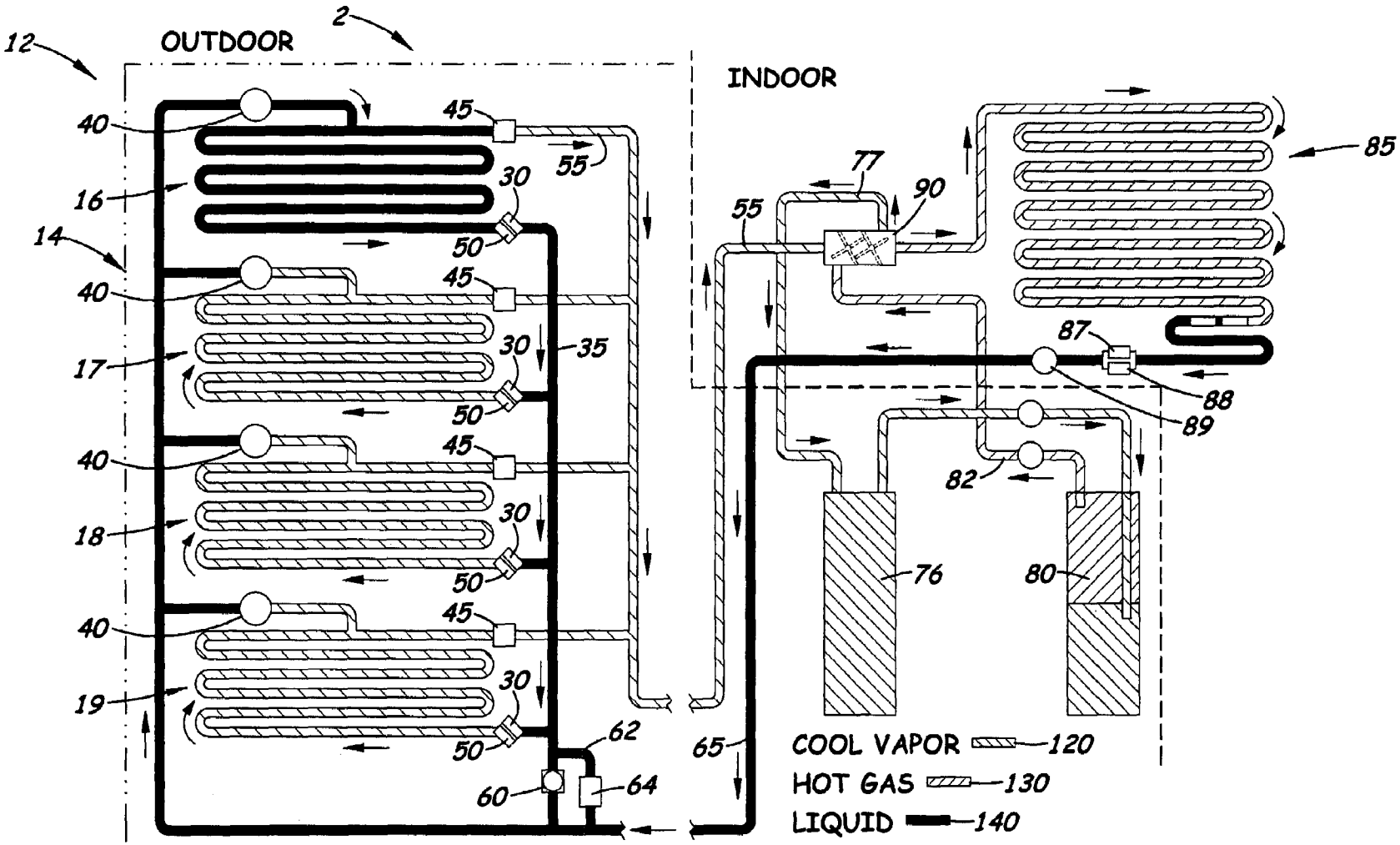
FIGS. 4C–F are a series of diagrams that shows different coil subsystems being individually defrosted while the other coil subsystems continue to provide indoor heat.
Figure 4D:
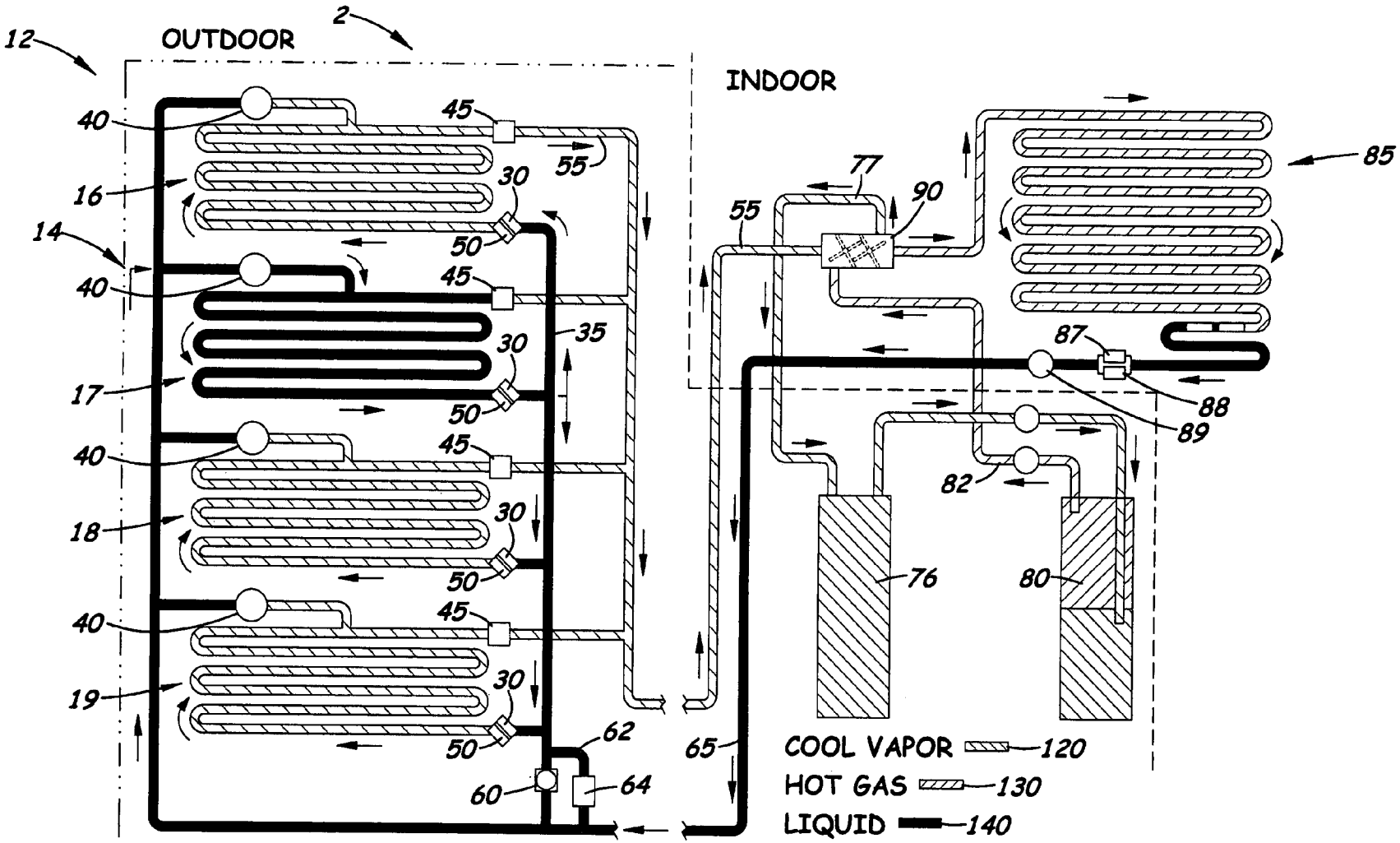
Figure 4E:
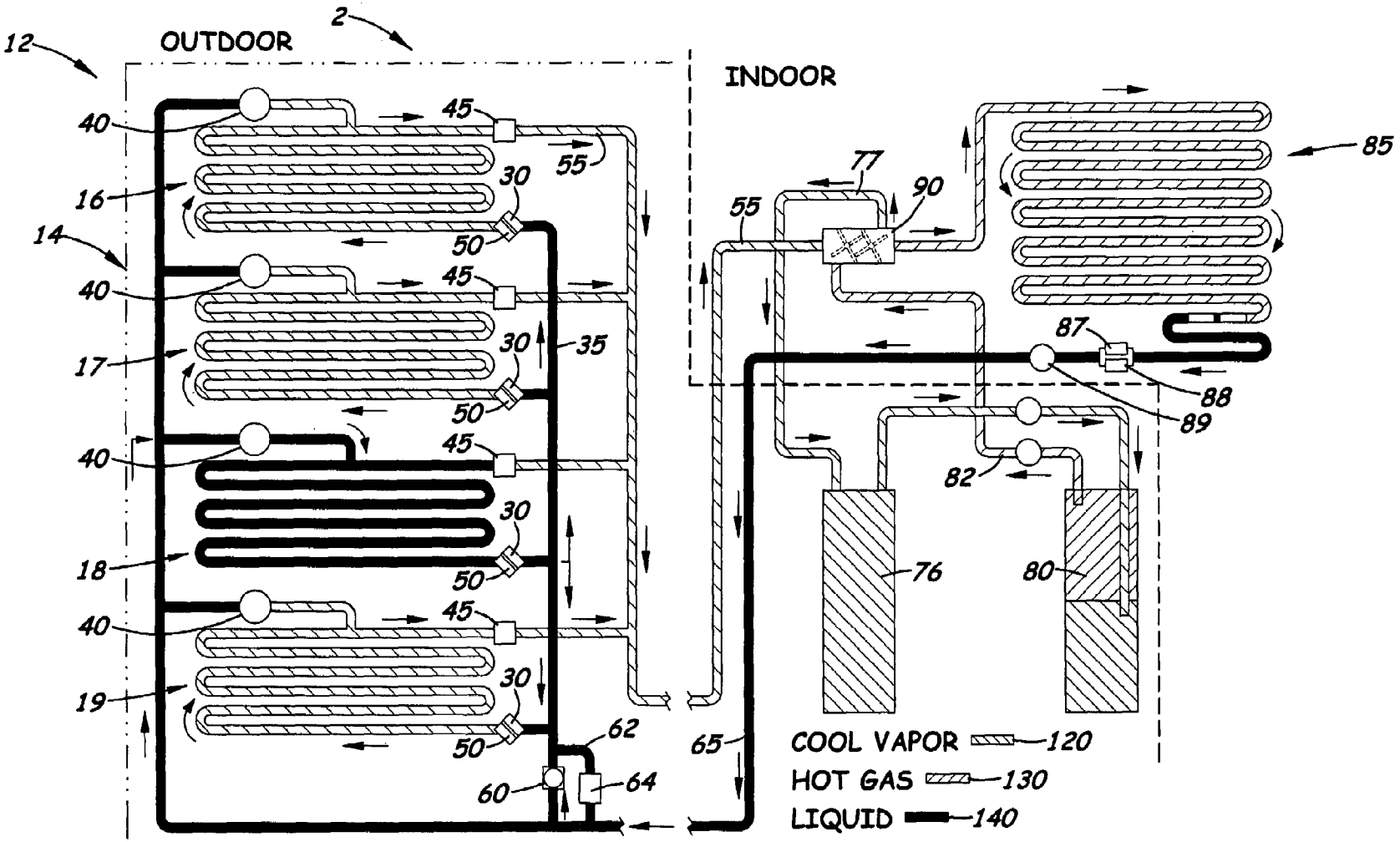
Figure 4F:
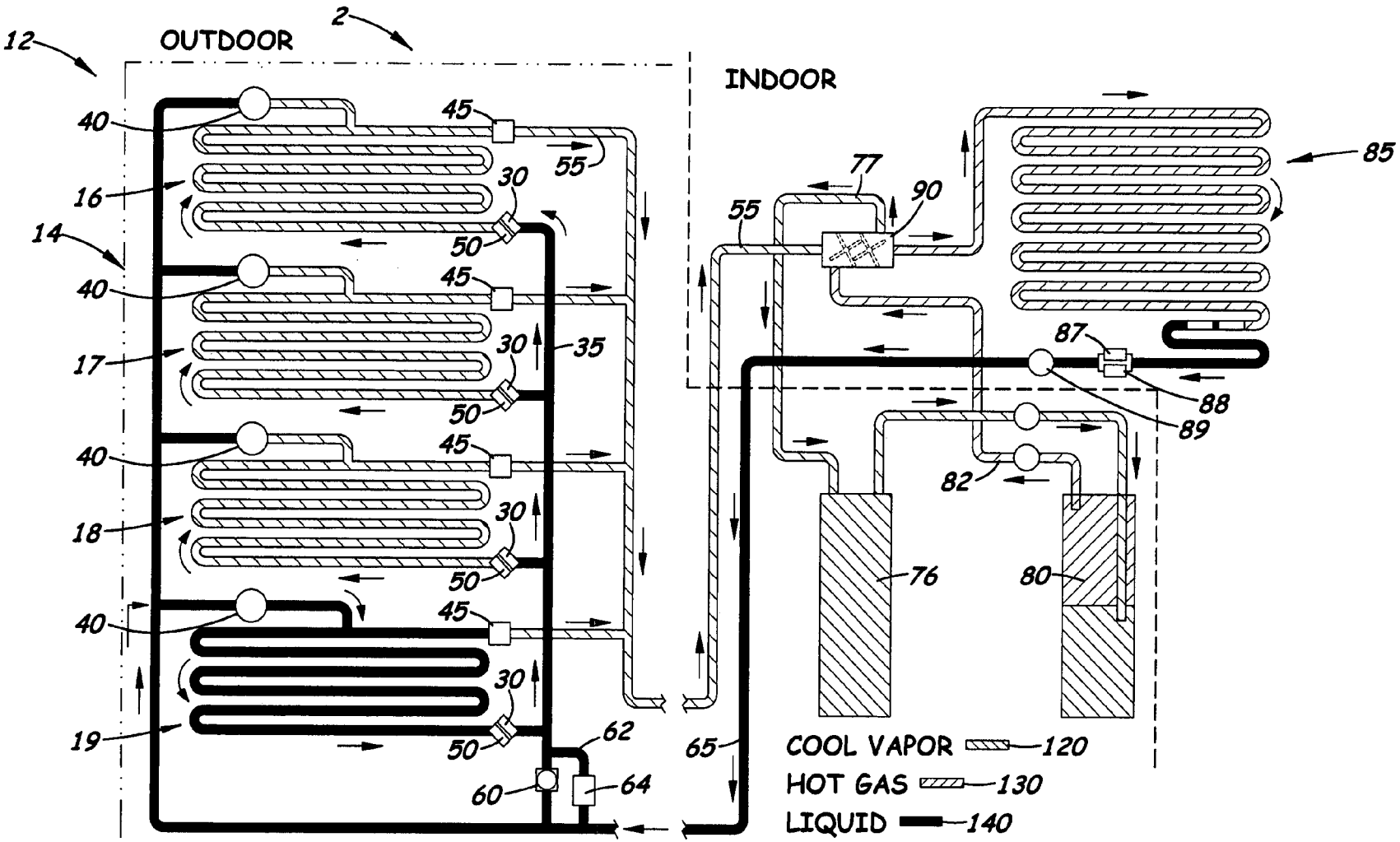
Figure 7:
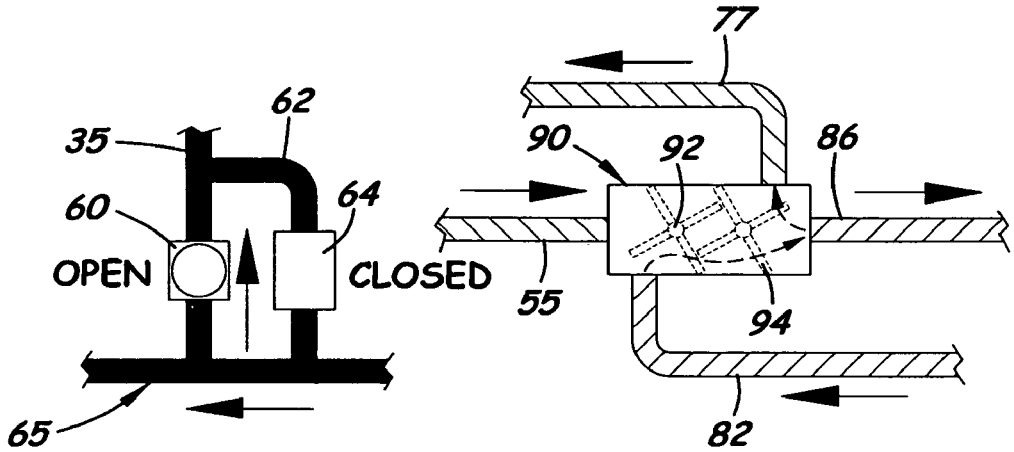
FIG. 7 is an illustration showing the flow of warm liquid refrigerant through the restrictor valve and the flows of cool vapor refrigerant and hot gas refrigerant through the reversing valve used on a combination heat pump/air conditioning unit operating a heating mode.
Figure 8:
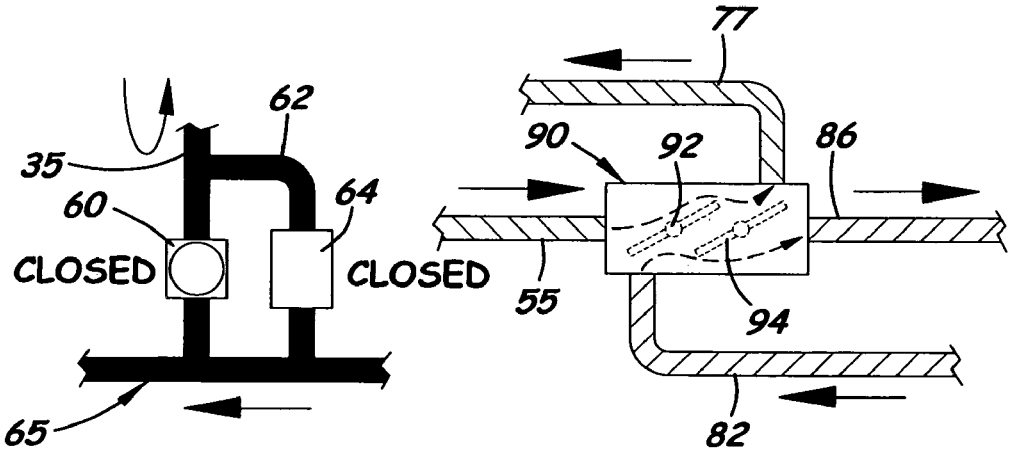
FIG. 8 is an illustration of the flow of the warm liquid refrigerant by-passing the restrictor valve and the flows of cool vapor refrigerant and hot gas refrigerant through the reversing valve used on the combination heat pump/air conditioning unit operating during a defrost mode.
Figure 7:
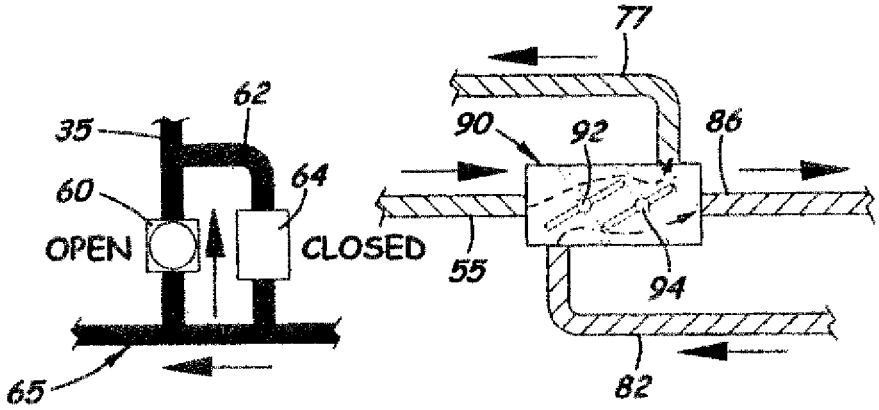
Figure 8:
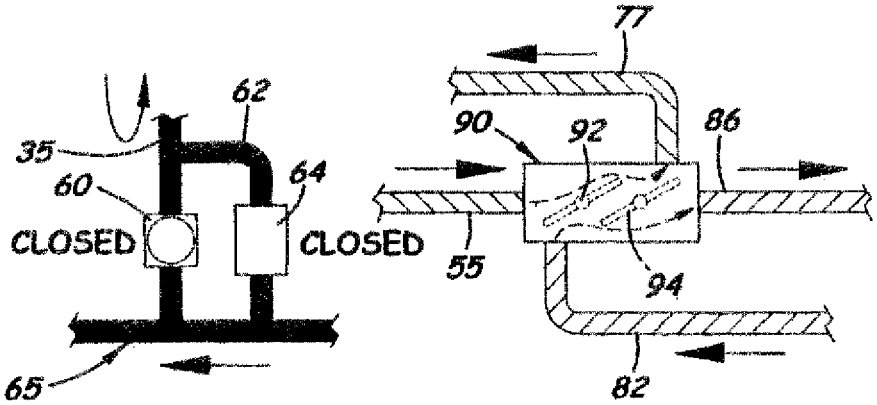

FIGS. 4B and 7 shows the operation of the combination heat pump/air conditioning unit 2 operating in heating mode. FIGS. 3B–E and FIGS. 4B–F are a series of illustrations showing how one coil unit is defrosted while the remaining coil subsystems in a heat pump unit 1 or combination heat pump/air conditioning unit 2 continue to operate in a heating mode. It should be understood that while in the following description only one coil subsystem is defrosted, the control unit 100 could be programmed so that two or more coil subsystems could be simultaneously defrosted while the one or more of the coil subsystems continue to exchange heat. It should also be noted that while the coil subsystems are described as being defrosted sequentially from top to bottom, the order in which the coil subsystems in the outer housing are defrosting may vary in different applications.

Figure 6:
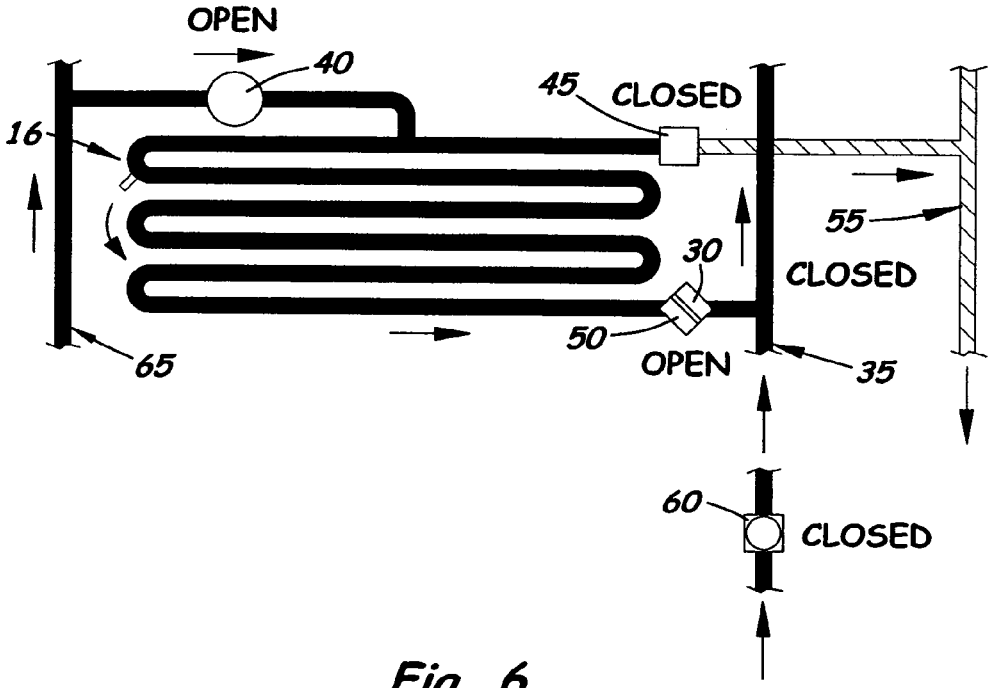
FIG. 6 is an illustration of the same outdoor coil subsystem shown in FIG. 5 showing the flow of warm liquid refrigerant through one coil subsystem during the defrost mode.

The defrost cycle is triggered by a timer 105 connected to the control unit 100 or by sensors 110 attached to the coil subsystems 16, 17, 18, 19 that are activated when the coil subsystems 16–19 reach a specific temperature. When triggered, the control unit 100 automatically initiates the defrost cycle on one of the coil subsystems. Referring to FIG. 6, when the defrost cycle begins, the liquid restrictor valve 60 is closed and the first bypass solenoid 40 on the coil subsystem 16 to be defrosted is opened thereby allowing warm liquid refrigerant 140 in the main liquid line 65 to be transmitted to the coil subsystem 16. The first bypass solenoids 40 on the other coil subsystems 17–19 remain closed. Simultaneously, the suction line solenoid 45 on the coil subsystem 16 is closed thereby transmitting warm liquid refrigerant 140 through the main body 26 through the first bypass check valve 50 and eventually into the secondary liquid line 35. From the secondary liquid line 35, the warm liquid refrigerant 140 continues to flow through the metering devices 30 on the adjacent coil subsystem where it undergoes evaporation. On the adjacent coil subsystems 17–19, the suction line solenoids 45 open thereby allowing cool vapor refrigerant 120 to be transmitted via the outside refrigerant transit line 55 and eventually returned to the suction accumulator 76 and to the compressor 80.

FIGS. 4C–4F show the defrosting cycle in a combination heat pump/air conditioning unit 2 while it is operating in a heating mode. The defrost cycle is triggered in the same manner as described in the heat pump unit by a timer 105 connected to the control unit 100 or by sensors 110 attached to the coil subsystem that are activated with the coil subsystems reach a specific temperature. When the defrost cycle begins, the liquid restrictor valve 60 is closed and the first bypass solenoid 40 on the coil subsystem 16 to be defrosted is opened thereby allowing warm liquid refrigerant 140 in the main liquid line 65 to be transmitted to the coil subsystem. The first bypass solenoids 40 on the other coil subsystems 17–19 remain closed. Simultaneously, the suction line solenoid 45 on the coil subsystem 16 to be defrosted is closed thereby transmitting warm liquid refrigerant 140 through the main body 26, through the first bypass check valve 50 and eventually into the secondary liquid line 35. From the secondary liquid line 35, the warm liquid refrigerant 140 continues to flow through the metering devices 30 on the adjacent coil subsystem where it undergoes evaporation. On the adjacent coil subsystems, 17–19, the suction line solenoids 45 are open thereby allowing cool vapor refrigerant 120 to be transmitted via the outside refrigerant transit line 55 to the reversing valve 90 and eventually to the suction accumulator 76. From the suction accumulator 76 the cool vapor refrigerant 120 travels to the compressor 80 and eventually to the indoor coils 85, as a hot gas refrigerant 130.

The above process of sequentially defrosting the individual coil subsystems is repeated until all of the coil subsystems 16–19 have been defrosted. The entire cycle may be continuously repeated or repeated when excess defrost has been detected or a specific amount of time has elapsed.

As mentioned above the restrictor valve may be an electrical valve controlled by the control unit 100 or a mechanical valve or pneumatic valve controlled by flow of refrigerant.

In summary, the above system 10 uses the flow of warm liquid refrigerant 140 through the coil subsystems 16–19 to selectively control defrosting of the coil subsystems one at a time. As the defrost process takes place in coil subsystem, the coil subsystems continue to exchange heat and warm the building. When the coil subsystem is defrosted, warm liquid refrigerant 140 is then directed to another coil subsystem. When all of the coils systems in the outer housing 12 are sequentially defrosted, the defrost cycle may begin again with the first coil subsystem. An important benefit of the system is the amount of energy required to defrost the coil subsystem is lower than the amount of energy need to defrost the coils in a standard outdoor unit. Also, because the other coil subsystems continue to operated while one set of coil subsystem is defrosted, the heat is continuously provided to the building thereby eliminating the need for supplemental heating units.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A method for maintaining the production of heat on an indoor heat exchanger connected to an outdoor heat exchanger that uses cool vapor refrigerant to produce heat for the indoor heat exchanger while selectively defrosting the outdoor heat exchanger, said method comprising the following steps;

a. selecting an outdoor heat exchanger that includes plurality of coil subsystems each being connected at two ends to a main liquid refrigerant line that connects to the indoor heat exchanger and at a third end to a secondary transfer line that connects to said indoor heat exchanger;

b. monitoring the temperature or the accumulation of frost on each said coil subsystem on said outdoor heat exchanger; and, c. selectively stopping the flow of said cool vapor refrigerant from said secondary transfer line through at least one said coil subsystem when a low temperature is detected or accumulation of frost is detected thereon while maintaining the flow of cool vapor refrigerant from said secondary transfer line in the remaining coil subsystems to produce heat for said indoor heat exchanger.

2. The method for defrosting an outdoor heat exchanger as recited in claim 1, wherein said outdoor heat exchanger is used on a heat only heat pump.

3. The method for defrosting an outdoor heat exchanger as recited in claim 1, wherein said outdoor heat exchanger is used on a combination heat pump/air conditioner unit.

4. A heat exchange liquid defrost system used with a building heat exchange system, that includes a compressor, an indoor heat exchange coil system, a main liquid conduit connected between said compressor and said indoor heat exchange coil system, at least one metering device connected to said main liquid refrigerant line and at least one control valve connected to said main liquid refrigerant line to control the direction of flow of liquid refrigerant through said heat exchange system, said heat exchange liquid defrost system comprising:

a. an outer housing;

b. at least two coil subsystems located inside said outer housing, each said coil subsystem includes an inlet tubing section, a t-joint, a first end tube section, a main body section, and a second end tube section, said inlet tubing section being connected at one end to said main liquid refrigerant line from said indoor heat exchanger, said t-joint being disposed between said inlet tubing section, said main body section, and said first end tube section;

c. a bypass solenoid located in said inlet tubing section of each said coil subsystem capable of controlling the flow of liquid refrigerant therethrough;

d. a suction line solenoid located in said first end tube section used to control the flow of refrigerant therethrough, the closing and opening operation of said suction line solenoid being opposite to the closing and opening operation of said bypass solenoid;

e. a metering device located in said second tube section, said metering device being used to change the state of a refrigerant from a liquid flowing through said second tube section to a vapor;

f. a first bypass check valve located in said second tube section, said first bypass check valve being open to allow the flow of liquid refrigerant through said second tube section when said metering device connected to said second tube section is not used to change the state of said refrigerant flowing through said second tube section;

g. an outdoor refrigerant transfer line that extends between said suction line solenoid used on each said coil subsystem and connects to said compressor used on said building heat exchange system;

h. a secondary liquid line that extends between each said meter device and said first bypass check valve in each said coil subsystem and connects to said main liquid refrigerant line;

i. a restrictor valve disposed in said secondary liquid line between said main liquid refrigerant line and the last coil subsystem, said restrictor valve functioning is an open or close direction opposite the open and close direction of said bypass solenoid; and, j. means for controlling the operation of said bypass solenoid and said suction line solenoid so that said coil subsystems may be individually defrosted with liquid refrigerant from said indoor heat exchange coil system.

5. A heat exchange liquid defrost system, as recited in claim 4, wherein said building heat exchange system is a heat only heat pump unit.

6. A heat exchange liquid defrost system, as recited in claim 4, wherein said building heat exchange system is a combination, heat and air condition unit.

7. A heat exchange liquid defrost system, as recited in claim 4, wherein said restrictor valve is a mechanical valve.

8. The heat exchange liquid defrost system, as recited in claim 4, where in said restrictor valve is a pneumatic valve.

9. The heat exchange liquid defrost system, as recited in claim 4, wherein said restrictor valve is an electric valve connected to said control unit.

10. The heat exchange liquid defrost system, as recited in claim 4, further including at least one sensor connected to each coil subsystem used to detect the temperature or the accumulation of frost on said coil subsystem.

* * * * *

UNITED STATES PATENT AND TRADEMARK OFFICE

CERTIFICATE OF CORRECTION

PATENT NO. : 7,171,817 B2
APPLICATION NO. : 11/027394
DATED : February 6, 2007
INVENTOR(S) : Daniel J. Birgen It is certified that error appears in the above-identified patent and that said Letters Patent is hereby corrected as shown below:

Delete Fig. 7 and replace with Fig. 7 attached herein.

Signed and Sealed this

Fifteenth Day of September, 2009

David J. Kappos

David J. Kappos
*Director of the United States Patent and Trademark Office*